United States Patent [19]

Buchmüller et al.

[11] Patent Number: 4,512,265

[45] Date of Patent: Apr. 23, 1985

[54] WET ASH REMOVER

[75] Inventors: Horst Buchmüller, Hünxe; Bernhard Michelbrink, Wesel, both of Fed. Rep. of Germany

[73] Assignee: Deutsche Babcock Aktiengesellschaft, Oberhausen, Fed. Rep. of Germany

[21] Appl. No.: 366,789

[22] Filed: Apr. 9, 1982

Related U.S. Application Data

[63] Continuation of Ser. No. 182,862, Sep. 2, 1980, abandoned, which is a continuation of Ser. No. 006,580, Jan. 26, 1979, abandoned.

[30] Foreign Application Priority Data

Jul. 11, 1978 [DE] Fed. Rep. of Germany ..... 2830380

[51] Int. Cl.[3] ..... F23J 1/02

[52] U.S. Cl. ..... 110/171; 110/165 R

[58] Field of Search ..... 110/165 R, 165 A, 170, 110/171, 167, 168, 259; 198/616, 718, 728; 414/214

[56] References Cited

U.S. PATENT DOCUMENTS

| | | | |
|---|---|---|---|
| 2,983,234 | 5/1961 | Reilly | 110/165 R |
| 3,456,798 | 7/1969 | Urdanoff | 210/167 |
| 3,515,260 | 6/1970 | Clyne | 198/728 |
| 3,915,105 | 10/1975 | Michelbrine | 110/171 |
| 3,932,280 | 1/1976 | Anderson | 110/259 |
| 3,935,825 | 2/1976 | Matthews et al. | 110/165 R |
| 4,202,280 | 5/1980 | Bereiter | 110/165 A |
| 4,213,402 | 7/1980 | Kochey | 110/171 |
| 4,329,929 | 5/1982 | Jessen | 110/171 |

FOREIGN PATENT DOCUMENTS

| | | | |
|---|---|---|---|
| 1175710 | 8/1964 | Fed. Rep. of Germany | 110/165 R |
| 2312625 | 9/1973 | Fed. Rep. of Germany | 110/165 R |

*Primary Examiner*—Henry C. Yuen
*Attorney, Agent, or Firm*—Max Fogiel

[57] ABSTRACT

A wet ash remover which has a trough arranged underneath the ash funnel of a boiler and is filled with quenching water. A quenching water feed and an overflow are also provided. Ash conveying equipment passes through the wet ash remover. A cooling device with quenching water circulating through it continuously, is located between the overflow and the quenching water feed. One or more sets of parallel oblique plates are located inside the trough in front of the overflow. The set or sets of plates may extend throughout the entire length side of the wet ash remover. The plates may be inclined 50 to 60 degrees from the horizontal, and the planes may be planar. One of the sidewalls of the displaceable trough is connected detachably to the remainder of the trough and rigidly to stationary supports; the sidewall is at least as long as the immersion piece of the ash funnel protruding into the trough. The sidewall may accommodate the overflow and the set or sets of plates.

8 Claims, 2 Drawing Figures

WET ASH REMOVER

The present application is a continuation of the parent application Ser. No. 182,862 filed Sept. 2, 1980, now abandoned, which application Ser. No. 182,862 filed Sept. 2, 1980 is a continuation of parent application Ser. No. 006,580 filed Jan. 26, 1979, now abandoned.

BACKGROUND OF THE INVENTION

The present invention relates to a wet ash remover consisting of a trough which is arranged underneath the ash funnel of a boiler, is filled with water, is provided with a fresh water feed and an overflow and through which an ash conveying device is conducted.

In these wet ash remover plants, the quenching water is guided in an open cycle where fresh water is added in case of need. The additional fresh water becomes necessary to compensate for water losses which arise through entrainment and removal from the trough together with the cooled ash and through evaporation due to entering heat radiation. Beyond that, the fresh water addition serves to cool the quenching water which warms up through contact with the hot ash.

Depending on the manner of operation of the boiler or the ash composition, a more or less high proportion of the ash can arise as floating substance or in the shape of finest particles. If the used quenching water must be cleaned before the delivery to public waters, then this involves an appreciable technical effort in the case of ashes of that kind. If, furthermore, only dirty water or sea water is available in sufficient quantity, then difficulties can arise through annoying smell in the immediate vicinity of the wet ash remover or through corrosion of the wet ash remover parts.

It is an object of the present invention to provide a wet ash remover of the initially named kind that, with simpler construction, can be operated independently of the quantity and the quality of the water available locally.

Another object of the present invention is to provide an arrangement of the foregoing character which is substantially simple in construction and may be economically fabricated.

A further object of the present invention is to provide a wet-ash remover, as described, which may be readily maintained in service and which has a substantially long operating life.

SUMMARY OF THE INVENTION

The objects of the present invention are achieved by arranging a cooling device, through which the water is circulated, between the overflow and the quenching water feed, and locating one or more sets of several parallely arranged, obliquely extending plates within the trough before the overflow.

Due to the closed cycle, a substantially smaller quantity of quenching water can be used in comparison with an open cycle. In this case, it is justifiable to use clean water. Through the arrangement of the known parallel precipitator plates, floating substances or finest particles possibly entrained by the quenching water are effectively held back. The temperature of the quenching water is lowered in the cooling equipment. In that case, any available water or also another medium, such as for example air, can be drawn upon as cooling medium.

In order to be able, in a simple manner, to change or move the wet ash remover, especially in the case of very elongate ash funnels, it is proposed in an embodiment of the present invention that one of the side walls of the moveable trough consists of a component which is connected detachably with the remaining trough and rigidly with stationary supports, where the length of the component amounts to at least the length of the immersion piece of the ash funnel protruding into the trough. In that case, the component detachably connected with the trough can receive the overflow and the set or sets of parallel plates. A component constructed in that manner can, after each change, again be brought into a sealed position relative to the remaining wet ash remover.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
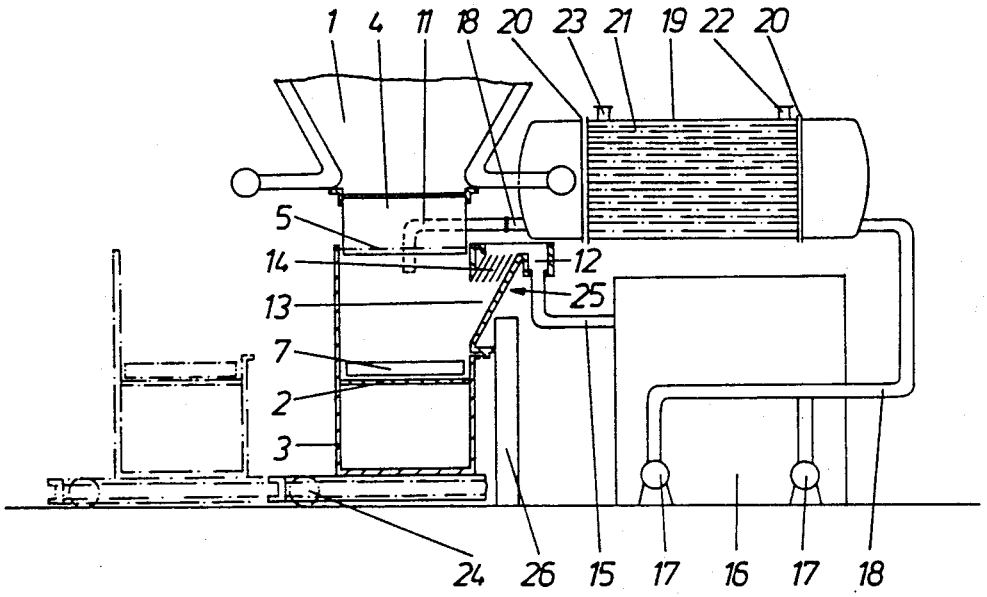
FIG. 1 shows a longitudinal section through a wet ash remover according to the present invention.

The wet ash remover is used in coal dust combustion chambers of steam boiler plants. The ash moves from the ash funnel 1 of a boiler into a trough 3 filled with quenching water above a closed intermediate bottom 2. The lower end of the ash funnel 1 dips with an immersion piece 4 into the water level 5 within the trough 3. The ash funnel 1 is thus movably sealed off relative to the trough 3. The trough 3 is open at the top and rises towards one side. A conveying device constructed as scraper chain conveyor runs into the trough 3 for carrying out the cooled ash. The scraper chain conveyor consists of two chains 6, between which scraping irons 7 are fastened at a distance apart. The chains 6 are guided in the direction of the arrows 8 over rollers 9. The ash falling into the wet ash remover is conveyed by the scraping irons 7 of the upper run of the scraper chain conveyor to the ash outlet 10 and discharged there.

The quenching water is fed to the trough 3 through a quenching water feed 11, which reaches into the trough 3. The trough 3 is provided at one side with an overflow 12.

Several sets of parallel plates 14 are arranged in front of the overflow 12 within an obliquely rising channel piece 13 of the trough 3 and beside one another in the longitudinal direction thereof. The number of the plates depends on the length of the trough 3. The plates 14 are planar and can consist of synethic material. They are held at a predetermined spacing by spacers. The inclination of the plates 14 relative to the horizontal amounts to about 50° to 60°. The plates extend over almost the entire longitudinal side of the trough 3.

The feed and the outflow of the quenching water as well as the length of the sets is so designed that a laminar flow forms between the plates 14. An ash particle impinging on one of the inclined plates 14 sinks due to the small flow speed prevailing in the edge zone. The floating substances present in the quenching water are thus precipitated between the plates 14 and do not get into the overflow 12. Through the utilization of almost a full longitudinal side of the wet ash remover for the plates 14, a good degree of precipitation results from the relatively large surface.

The overflow 12 is connected through pipe ducts 15 with an intermediate container 16, to which one or more pumps 17 are connected. The pumps 17 convey the quenching water cleaned between the plates 14 through a duct system 18 into a closed circuit through a cooling device 19 back to the quenching water feed 11. The cooling equipment can, according to FIG. 1, consist of a tube apparatus, in which tubes 24, arranged between two tube plates 20, have the quenching water flow through them. The recooling medium for the indirect cooling of the quenching water can be withdrawn from an open body of water and finally returned back there. Corrosive sea water or also dirty water, for example, from a sewer, can also be used as recooling medium. It is fed into the cooling device 19 through an entry stub 22, flows around the space outside the tubes 21 and is subsequently conducted away through an outlet stub 23.

Figure 2:
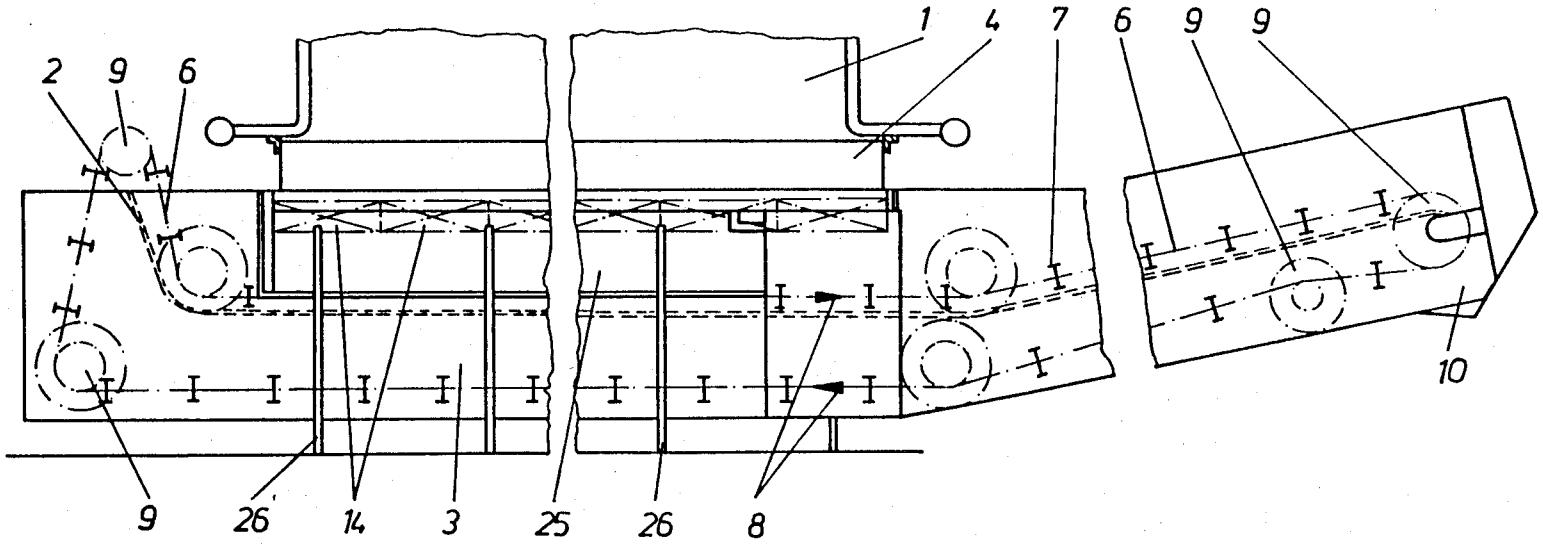
FIG. 2 shows the associated side elevation.

The trough 3 is constructed to be displaceable for purposes of repair or inspection and provided with wheel sets 24. Since the immersion piece 4 would obstruct a displacement of the trough 3 and pivotable flaps of great lengths are difficult to seal, one side wall of the trough 3 is formed of a component 25, which is rigidly connected with one or more stationary supports 26. This component 25 is detachably connected to the remaining trough 3 by screws and sealing strips. The length of the component 25 corresponds to at least the length of the immersion piece 4. After discharging the quenching water and detaching the component 25, the trough 3 can be displaced as illustrated by broken lines in FIG. 2, while the component 25 remains connected to the supports 26. When a precipicating device consisting of the plates 14 is provided, it is recommended that the component 25 include these plates 14 together with the channel piece 13 and the overflow 12.

The use of the wet ash remover has been described in the preceding example of embodiment in connection with a scraper chain conveyor. It can of course be used also with other units, for example with plate belt conveyors.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention, and therefore, such adaptations should and are intended to be comprehended within the meaning and range of equivalence of the following claims.

What is claimed is:

1. A wet ash remover comprising: a trough arranged underneath the ash funnel of a boiler; said trough being filled with quenching water; a quenching water feed means and an overflow means located on said trough; ash conveying means passing through said trough; cooling means located between said overflow means and said quenching water feed means for cooling said quenching water, quenching water being continuously circulated through said cooling means, said quenching water being cooled by a coolant isolated from said quenching water in said cooling means; and at least one set of a plurality of immovable parallel plates located inside said trough immediately in front of said overflow means, said plates being inclined and spaced from each other and forming parallel and inclined passages for the quenching water, said plates having means so that particles of ash suspended in the quenching water are precipitated between said plates and thereby retained in said trough; immersion means connected to said ash funnel and having lower edges dipping below the level of the quenching water within said trough for sealing off the trough from the ash funnel, said quenching water being cooled by said cooling means subsequent to precipitation of said particles of ash.

2. A wet ash remover as defined in claim 1 wherein said set extends across the entire length side of said wet ash remover.

3. A wet ash remover as defined in claim 1 wherein said plates are inclined 50 to 60 degrees.

4. A wet ash remover as defined in claim 1 wherein said plates are planar.

5. A wet ash remover as defined in claim 1 including a sidewall of said trough, said trough being movable; stationary supports; said sidewall being detachably connected to the remainder of said trough and being rigidly connected to said stationary supports; the length of said sidewall being at least equal to the length of an immersion member of an ash funnel, said immersion member protruding into said trough.

6. A wet ash remover as defined in claim 5 wherein said sidewall receives said set of parallel plates and said overflow means.

7. A wet ash remover comprising: a trough arranged underneath the ash funnel of a boiler; said trough being filled with quenching water; a quenching water feed means and an overflow means located on said trough; ash conveying means passing through said trough; cooling means located between said overflow means and said quenching water means for cooling said quenching water, quenching water being continuously circulated through said cooling means, said quenching water being cooled by a coolant isolated from said quenching water in said cooling means; and at least one set of a plurality of immovable parallel plates located inside said trough immediately in front of said overflow means, said plates being inclined and spaced from each other and forming parallel and inclined passages for the quenching water, said plates having means so that particles of ash suspended in the quenching water are precipitated between said plates and thereby retained in said trough; immersion means connected to said ash funnel and having lower edges dipping below the level of the quenching water within said trough for sealing off the trough from the ash funnel; a sidewall of said trough, said trough being movable; stationary supports; said sidewall being detachably connected to the remainder of said trough and being rigidly connected to said stationary supports; the length of said sidewall being at least equal to the length of said immersion means; said set of plates extending across the entire length side of said wet ash remover; said plates being inclined 50 to 60 degrees; said plates being planar; said sidewall receiving said set of parallel plates and said overflow means, said plates having laminar flow therebetween, ash particles impinging on said plates sinking due to said laminar flow in edge zones so that ash particles are precipitated between said plates and do not enter said overflow means.

8. A wert ash remover comprising: a trough arranged underneath the ash funnel of a boiler; said trough being filled with quenching water; a quenching water feed means and an overflow means located on said trough;

ash conveying means passing through said trough; cooling means located between said overflow means and said quenching water means for cooling said quenching water; quenching water being continuously circulated through said cooling means, said quenching water being cooled by a coolant isolated from said quenching water in said cooling means; and at least one set of a plurality of immovable parallel plates located inside said trough immediately in front of said overflow means, said plates being inclined and spaced from each other and forming parallel and inclined passages for the quenching water, said plates having means so that particles of ash suspended in the quenching water are precipitated between said plates and thereby retained in said trough; immersion means connected to said ash funnel and having lower edges dipping below the level of the quenching water within said trough for sealing off the trough from the ash funnel; a sidewall of said trough, said trough being movable; stationary supports; said sidewall being rigidly connected to said stationary supports; the length of said sidewall being at least equal to the length of said immersion means; said set of plates extending across the entire length side of said wet ash remover; said plates being planar; said sidewall receiving said set of parallel plates and said overflow means, said plates having laminar flow therebetween, ash particles impinging on said plates sinking due to said laminar flow in edge zones so that ash particles are precipitated between said plates and do not enter said overflow means.

* * * * *